US011351592B2

(12) United States Patent
Ihara et al.

(10) Patent No.: US 11,351,592 B2
(45) Date of Patent: Jun. 7, 2022

(54) METHOD OF PROCESSING STEEL PLATE AND PUNCHING MACHINE

(71) Applicant: TOYOTA JIDOSHA KABUSHIKI KAISHA, Toyota (JP)

(72) Inventors: Tomoaki Ihara, Toyota (JP); Shunsuke Tobita, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 212 days.

(21) Appl. No.: 16/732,780

(22) Filed: Jan. 2, 2020

(65) Prior Publication Data

US 2020/0238360 A1 Jul. 30, 2020

(30) Foreign Application Priority Data

Jan. 25, 2019 (JP) ..... JP2019-011011

(51) Int. Cl.
*B21D 28/26* (2006.01)

(52) U.S. Cl.
CPC ..... *B21D 28/26* (2013.01)

(58) Field of Classification Search
CPC ..... B21D 28/26; B21D 28/34; B21D 28/02; B21D 28/04
See application file for complete search history.

(56) References Cited

U.S. PATENT DOCUMENTS

2009/0235715 A1 9/2009 Werz
2012/0111161 A1* 5/2012 Kuriki ..... B21D 28/26 83/16
2017/0333971 A1* 11/2017 Denks ..... B21D 22/04
2019/0039109 A1* 2/2019 Haslmayr ..... C21D 1/18
2019/0091752 A1* 3/2019 Takishima ..... B21D 19/088
2020/0239974 A1 7/2020 Ihara et al.
2020/0291999 A1* 9/2020 Mizuta ..... B21J 1/06
2021/0154723 A1* 5/2021 Shinke ..... B21D 37/01

FOREIGN PATENT DOCUMENTS

| | | | | |
|---|---|---|---|---|
| CA | 3012168 | A1 * | 7/2017 | ..... B21D 19/088 |
| CN | 107208170 | A | 9/2017 | |
| EP | 3212348 | B1 | 9/2018 | |
| JM | 7-303919 | A | 11/1995 | |
| JP | 6-226479 | A | 8/1994 | |
| JP | 2002-113525 | A | 4/2002 | |
| JP | 2007-319912 | A | 12/2007 | |
| JP | 2012-206539 | A | 10/2012 | |

OTHER PUBLICATIONS

Office Action dated Oct. 27, 2021 in U.S. Appl. No. 16/750,373.
ASM International, "Fundamentals of the Heat Treating of Steel", 2006, ASM International, Practical Heat Treating, 2nd Edition, pp. 9-10 (18 pages total).

* cited by examiner

*Primary Examiner* — Gregory D Swiatocha
*Assistant Examiner* — Bobby Yeonjin Kim
(74) *Attorney, Agent, or Firm* — Sughrue Mion, PLLC

(57) ABSTRACT

A method for processing a steel plate includes punching a steel plate as a workpiece fixed to a punching die by a punch, making a first heating electrode provided on a punch holder for supporting the punch and a second heating electrode provided on the punching die face each other by maintaining the punch in a state in which the punch penetrates the steel plate and heating a part of the steel plate including a trim edge punched in the punching, and pulling out the punch from the punching die.

8 Claims, 6 Drawing Sheets

METHOD OF PROCESSING STEEL PLATE AND PUNCHING MACHINE

CROSS REFERENCE TO RELATED APPLICATIONS

This application is based upon and claims the benefit of priority from Japanese patent application No. 2019-11011, filed on Jan. 25, 2019, the disclosure of which is incorporated herein in its entirety by reference.

BACKGROUND

The present disclosure relates to a method for processing a steel plate and a punching machine.

One of the issues in press-forming of a high tensile strength steel is cracking in a stretch flange. This cracking in a stretch flange occurs due to residual strain on a shear end face. As a method for reducing this residual strain, a heating method is known. As a method for heating a residual strain part, a technique for applying a current and heating a bent part of a press formed product to remove residual strain is known (see, for example, Japanese Unexamined Patent Application Publication No. H07-303919).

SUMMARY

There has been a problem that it is difficult to transfer heat to an end part of a steel plate punched in punching processing and residual strain cannot be completely removed or when an end part of a steel plate is heated to such an extent that residual strain can be removed, areas other than the end part are excessively heated, thereby causing a change in the hardness of a part of the steel plate.

The present disclosure provides a method for processing a steel plate capable of removing residual strain at a trim edge thereof without causing overheating in areas of the steel plate other than the trim edge.

In a first example aspect of the present disclosure, a method for processing a steel plate includes: punching a steel plate as a workpiece fixed to a punching die by a punch; making a first heating electrode provided on a punch holder for supporting the punch and a second heating electrode provided on the punching die face each other by maintaining the punch in a state in which the punch penetrates the steel plate and heating a part of the steel plate including a trim edge punched in the punching; and pulling out the punch from the punching die. By disposing the heating electrodes on the punch holder and at a position facing the punch holder in the punching machine, and applying a current to the heating electrodes while the punch is penetrating the steel plate, the trim edge can be sufficiently ended. By heating the part of the steel plate including the trim edge, it is possible to appropriately remove residual strain and avoid overheating of areas other than the part of the steel plate including the trim edge.

The above processing method is effective if it further includes reducing heat generated in the heating and forming a stretch flange at the trim edge. When the stretch flange is formed on the steel plate in a state where the heat is reduced, damage to a flange die can be reduced.

Further, the pulling-out may be started based on a detected temperature of the trim edge. If the punch is pulled out when the temperature reaches an appropriate temperature, the residual strain can be removed appropriately, and softening and hardening of the steel plate can be avoided. Furthermore, relative positions of the punch holder and the punching die are preferably adjusted so that the first heating electrode and the second heating electrode face each other at a bottom dead center of the punch. Such an adjustment eliminates the need for complicated position control of the punch.

Further, each of the heating electrodes may be a coil electrode for generating an induced electromotive force in the steel plate to carry out the heating. The heating in this case includes heating the part of the steel plate without bringing the electrode into contact with a surface of the steel plate. When the steel plate is heated using an induced electromotive force in this manner, damage to the electrodes can be reduced, because the steel plate can be heated without bringing the electrodes into contact with the surface of the steel plate. When induction heating is used in this way, the trim edge can be efficiently heated by the edge effect. Moreover, when an insulator part is provided on a peripheral part of the coil electrode, in the above heating, the insulator part may be brought into contact with the surface of the steel plate to heat the above part of the steel plate. When the insulator part is brought into contact with the surface of the steel plate, it is possible to stably heat the steel plate while preventing damage to the coil electrode.

In a second example aspect of the present disclosure, a punching machine includes: a punch holder including a first heating electrode and configured to hold a punch for punching a steel plate as a workpiece; a punching die including a second heating electrode, the steel plate is being fixed to the punching die; and a current applying control unit configured to apply a current to the first heating electrode and the second heating electrode so that a part of the steel plate including a trim edge punched by the punch is heated when the first heating electrode and the second heating electrode face each other while the punch is penetrating the steel plate. By disposing the heating electrodes on the punch holder and at a position facing the punch holder in the punching machine, and applying a current to the heating electrodes while the punch is penetrating the steel plate, the trim edge can be sufficiently ended. By heating the part of the steel plate including the trim edge, it is possible to appropriately remove residual strain and avoid overheating of areas other than the part of the steel plate including the trim edge.

In a third example aspect of the present disclosure, a method for processing a steel plate includes: punching a steel plate as a workpiece fixed to a punching die by a punch; and heating a part of the steel plate including a trim edge punched in the punching by a first heating electrode provided on a fixing jig for fixing the steel plate to the punching die and a second heating electrode provided on the punching die.

In a fourth example aspect of the present disclosure, a punching machine includes: a punching die including a second heating electrode, a steel plate as a workpiece is being fixed to the punching die; a fixing jig including a first heating electrode and configured to fix the steel plate to the punching die; and an current applying control unit configured to apply a current to the first heating electrode and the second heating electrode so that a part of the steel plate including a trim edge punched by the punch is heated. According to the method for processing a steel plate in the third example aspect and the punching machine in the fourth example aspect, the heating electrodes are disposed on the fixing jig of the steel plate and at a position facing the fixing jig in the punching machine and then the trim edge is heated. Since the part of the steel plate including the trim edge of the steel plate as a workpiece can be heated, it is possible to appropriately remove residual strain and avoid overheating of areas other than the part of the steel plate including the trim edge.

According to the present disclosure, it is possible to provide a method for processing a steel plate capable of removing residual strain at a trim edge thereof without causing overheating in areas of the steel plate other than the trim edge.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Figure 1:
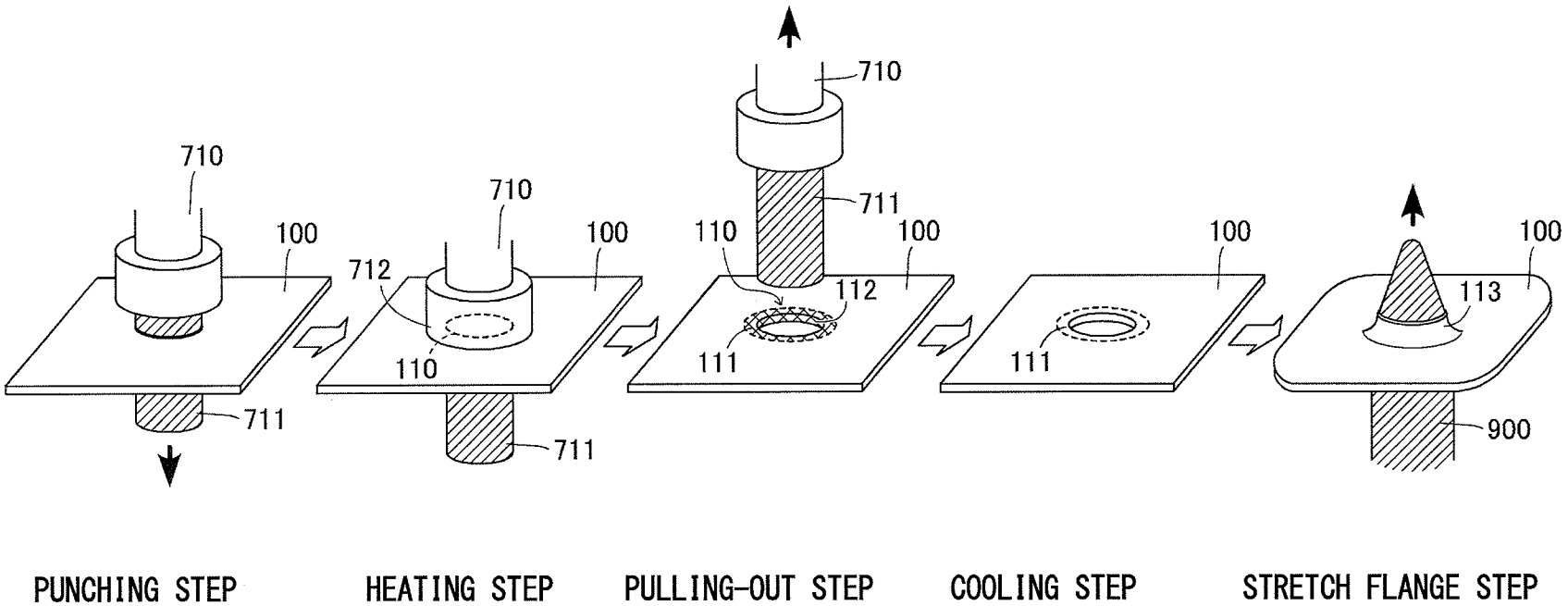
FIG. 1 is a schematic diagram schematically showing steps of a processing method according to an embodiment.

FIG. 1 is a schematic diagram schematically showing steps of a processing method according to this embodiment. In the processing method described below, a hole is punched through a steel plate as a workpiece, and a peripheral edge of the hole is deformed to form a stretch flange. As shown in FIG. 1, broadly speaking, the processing method includes a punching step of punching a steel plate, a heating step of heating a part of the steel plate including a trim edge, a pulling-out step of pulling out a punch, a cooling step of reducing the heat generated in the heating step, and a stretch flange step of forming a stretch flange at the trim edge.

The punching step includes punching a steel plate 100 fixed to a punching die by a punch 711 that moves forward and backward together with a support shaft 710 of an upper die. As will be described in detail later, the heating step is a step of pressing a punch holder 712 holding the punch 711 against the steel plate 100 and heating a peripheral edge of the hole 110 formed in the punching step. The pulling-out step is a step of pulling out the punch 711 from the punching die after the heating is ended. Note that as shown in the drawing, the area heated in the heating step is a heating area 111 including a trim edge of the hole 110, which area is a part of the steel plate 100.

The cooling step is a step of reducing the heat in the heating area 111 heated in the heating step. Specifically, the steel plate 100 is left for a certain time in a room temperature environment. The stretch flange step is a step of inserting a flange die 900 into the hole 110 and plastically deforming a peripheral edge part of the hole 110 to thereby form a stretch flange 113.

Residual strain generated at the peripheral edge part of the hole 110 in the punching step is removed in the heating step. After the cooling, the steel plate 100 is subjected to the stretch flange step. When the stretch flange is formed on the steel plate 100 in a cooled state, it is possible to reduce the damage to the flange die 900 more than when the stretch flange is formed on the steel plate 100 in a heated state. In particular, in this embodiment, since the steel plate 100 can be sufficiently heated up to the trim edge, the residual strain can be satisfactorily removed. This will be described later. Further, since the heating step can be performed between the punching step and the pulling-out step, an independent heating step of placing the steel plate 100 on a heating apparatus and heating it, which has been necessary in related art, can be omitted. This can shorten the time taken for a series of processing.

Figure 2:
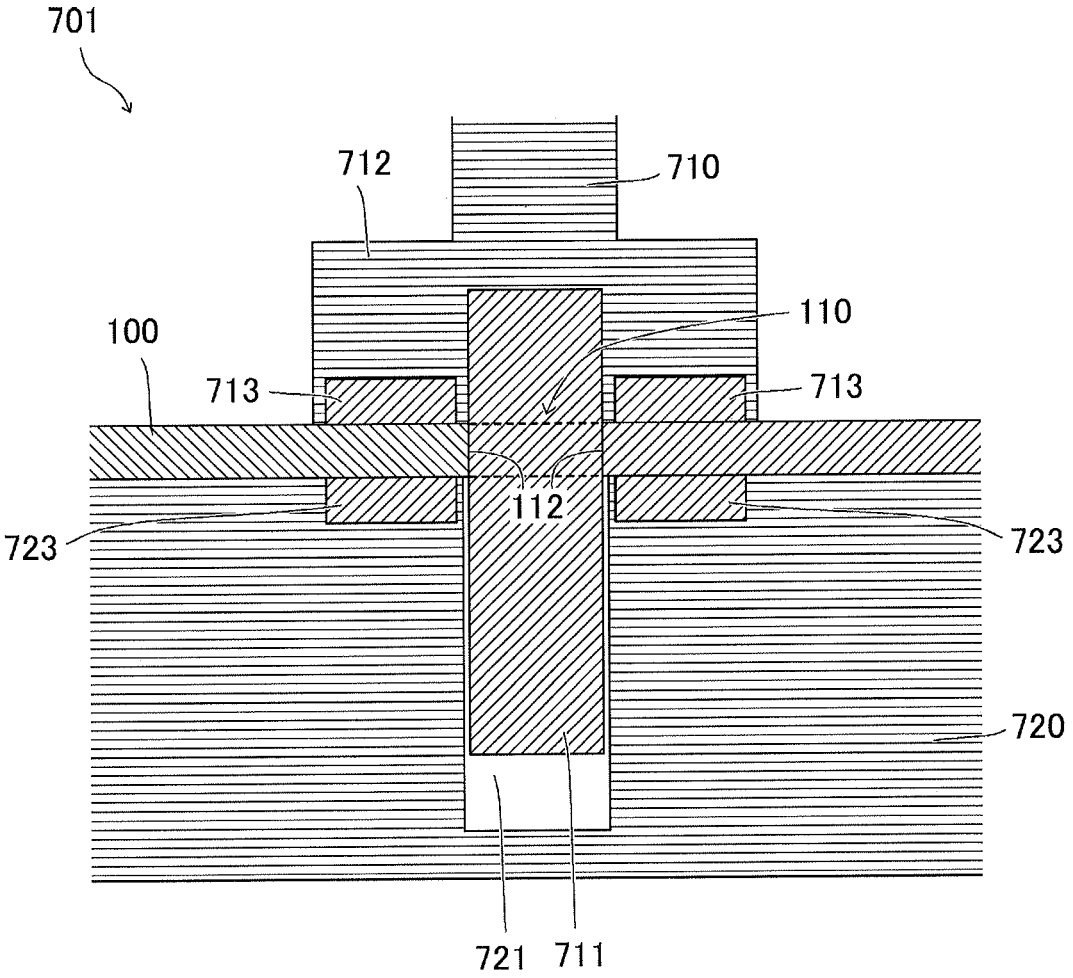
FIG. 2 is a partial cross-sectional view showing a state in which heating electrodes are brought into contact with a steel plate in a heating step.

FIG. 2 is a partial cross-sectional view of the heating electrodes brought into contact with the steel plate 100 in the heating step. Specifically, FIG. 2 schematically shows a partial cross section of the punching machine 701 and the steel plate 100 including the central axis of the hole 110. In the heating step, by maintaining the punch 711 in a state of penetrating the steel plate 100, the first heating electrode 713 and the second heating electrode 723, which are a pair of heating electrodes, sandwich the steel plate 100, and a current is applied to these heating electrodes to thereby heat the steel plate 100. Specifically, an electrode surface of the first heating electrode 713 is brought into contact with one surface side of the steel plate 100, and an electrode surface of the second heating electrode 723 is brought into contact with another surface side of the steel plate 100, and then a current is applied to the steel plate 100.

The heating temperature at this time is adjusted in such a way that a trim edge 112 becomes 200° C. or higher and lower than the Ac1 point. The residual strain can be appropriately removed when the heating is within this temperature range. In particular, when the steel plate 100 is heated to the Ac1 point or higher, the steel plate 100 undergoes austenite transformation. Thus, the steel plate 100 softens when air-cooled or hardens when rapidly cooled by running water or the like, and then formability in the stretch flange step decreases. Therefore, it is preferable to keep the heating temperature below the Ac1 point.

The punching machine 701 includes, as an upper die, the punch 711, a punch holder 712 including a first heating electrode 713 and detachably supporting the punch 711, and a support shaft 710 that is integrated with the punch holder 712 and moves the attached punch 711 back and forth. Since the first heating electrode 713 is provided on the punch holder 712, the first heating electrode 713 is located substantially near the base of the punch 711. The punching machine 701 further includes, as a lower die, a second heating electrode 723 and a punching die 720 to which the steel plate 100 is fixed. The punching die 720 includes a die hole 721 for retracting the punch 711 and a punched piece at the time of punching. The first heating electrode 713 and the second heating electrode 723 are disposed so as to face each other with the punch 711 penetrating the steel plate 100 and to be brought into contact with the respective surfaces of the steel plate 100.

The punching machine 701 further includes, as a part of the control mechanism, a current applying control unit that applies a current to the first heating electrode 713 and the second heating electrode 723 when the first heating electrode 713 and the second heating electrode 723 are brought into contact with the steel plate 100 and face each other. When a current is applied, the heating area 111 including the trim edge 112 shown in FIG. 1 is heated. When the heating area 111 is heated by such an arrangement of the pair of heating electrodes, the trim edge 112 can be sufficiently heated, and the residual strain concentrated on the peripheral part of the trim edge 112 can be satisfactorily removed. Further, since the heating area 111 is a part of the entire steel plate 100, electric power for heating unnecessary areas can be reduced, and overheating that causes softening and hardening can be avoided.

The first heating electrode 713 may be composed of a plurality of electrodes arranged apart from each other around the punch 711 instead of being an annular electrode surrounding the punch 711 as shown in the drawing. Likewise, the second heating electrode 723 may composed of a plurality of electrodes arranged apart from each other around the die hole 721 instead of being an annular electrode surrounding the die hole 721 as shown in the drawing. In any of these cases, the first heating electrode 713 and the second heating electrode 723 are provided in the vicinity of the punch 711 or the die hole 721 so that the trim edge 112 of the hole 110 to be formed can be sufficiently heated.

The relative positions of the punch holder 712 and the punching die 720 are adjusted in such a way that the first heating electrode 713 and the second heating electrode 723 face each other and are brought into contact with the steel plate 100 at the bottom dead center, which is the lowest end where the punching punch 711 reaches. For example, prior to using the punching machine 701, a user adjusts the relative positions of the punch holder 712 and the punching die 720 by correcting an initial position of the support shaft 710 in the vertical direction according to the thickness of the steel plate 100. Such an adjustment eliminates the need for complicated position control of the punch 711.

A heating time in the heating step may be a preset time or a time until the trim edge 112 reaches a preset temperature. In the latter case, for example, a temperature sensor may be provided between wall surfaces of the second heating electrode 723 and the die hole 721 in the punching die 720 to detect the temperature. The pulling-out step is started after such a heating time has elapsed. When the punch 711 is pulled-out when the temperature reaches an appropriate temperature, the residual strain can be removed appropriately, and the softening and hardening of the steel plate 100 can be avoided.

Figure 3:
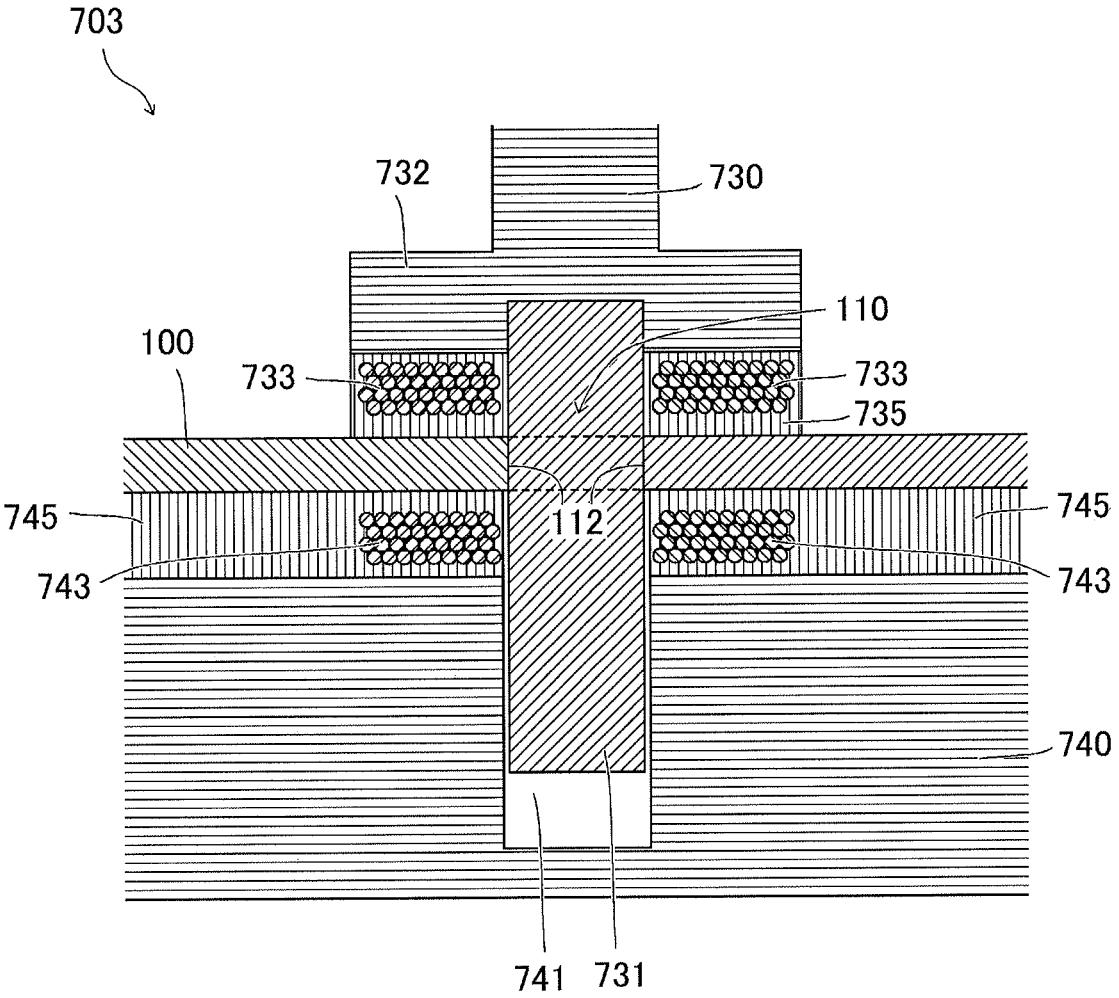
FIG. 3 is a partial cross-sectional view showing a relationship between the heating electrodes and the steel plate when another punching machine is used.

FIG. 3 is a partial cross-sectional view showing a relationship between heating electrodes and the steel plate 100 when another punching machine 703 is used. Like FIG. 2, FIG. 3 is a cross-sectional view showing one side of the punching machine 703 and the steel plate 100 including the central axis of the hole 110.

The pair of heating electrodes shown in the drawing is a coil electrode that applies an alternating current to generate an induced electromotive force in the steel plate 100 to thereby heat the steel plate 100. The pair of heating electrodes is composed of a first heating coil 733 and a second heating coil 743. The first heating coil 733 is surrounded by a first support 735 that is an insulator, and the second heating coil 743 is surrounded by a second support 745 that is an insulator. The heating step is carried out by maintaining the punch 731 in a state in which the punch 731 penetrates the steel plate 100 so that the first heating coil 733 and the second heating coil 743 face each other with the steel plate 100 interposed therebetween and then applying a current to these heating coils.

During the heating, the first support 735 and the second support 745 are brought into contact with the surfaces of the steel plate 100. As a result, the distance between the first heating coil 733 and the second heating coil 743 becomes stable, which makes it easy to control the temperature. Further, since the first heating coil 733 and the second heating coil 743 are not brought into direct contact with the surfaces of the steel plate 100, damage to the electrodes can be reduced. Note that the temperature range for the heating is the same as that for the punching machine 701.

The punching machine 703 includes, as an upper die, the punch 731, a punch holder 732 including the first heating coil 733 supported by the first support 735 and detachably supporting the punch 731, and a support shaft 730 that is integrated with the punch holder 732 and moves the attached punch 731 back and forth. The punching machine 703 further includes, as a lower die, a punching die 740 including the second heating coil 743 supported by the second support 745. The steel plate 100 is fixed to the punching die 740. The punching die 740 includes a die hole 741 for retracting the punch 731 and a punched piece at the time of punching. The first heating coil 733 and the second heating coil 743 are disposed so as to face each other while the punch 731 is penetrating the steel plate 100 and to be brought into contact with the respective surfaces of the steel plate 100.

The punching machine 703 further includes, as a part of the control mechanism, a current applying control unit that applies a current to the first heating coil 733 and the second heating coil 743 when the first heating electrode 733 and the second heating electrode 743 are brought into contact with the steel plate 100 and face each other. When a current is applied, the heating area 111 including the trim edge 112 shown in FIG. 1 is heated. When the heating area 111 is heated by such an arrangement of the pair of heating coils, the trim edge 112 can be sufficiently heated, and the residual strain concentrated on the peripheral part of the trim edge 112 can be satisfactorily removed in a manner similar to the punching machine 701.

The relative positions of the punch holder 732 and the punching die 740 are adjusted in such a way that the first support 735 is brought into contact with the steel plate 100 at the bottom dead center, which is the lowest end where the punching punch 731 reaches. A heating time in the heating step may be adjusted in a manner similar to that for the punching machine 701.

Figure 4:
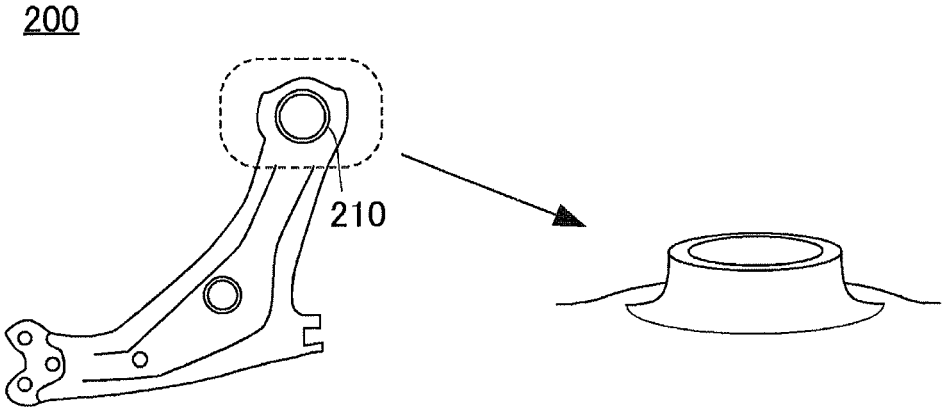
FIG. 4 illustrates an example of a formed product.

An example of a formed product formed by the above-described processing method will be described. FIG. 4 illustrates an FR lower arm 200 used for a vehicle suspension as an example of the formed product. As shown in an enlarged view of a part surrounded by a dotted line, a bush press-fitting part 210 of the FR lower arm 200 is formed by the above-described processing method.

Figure 5:
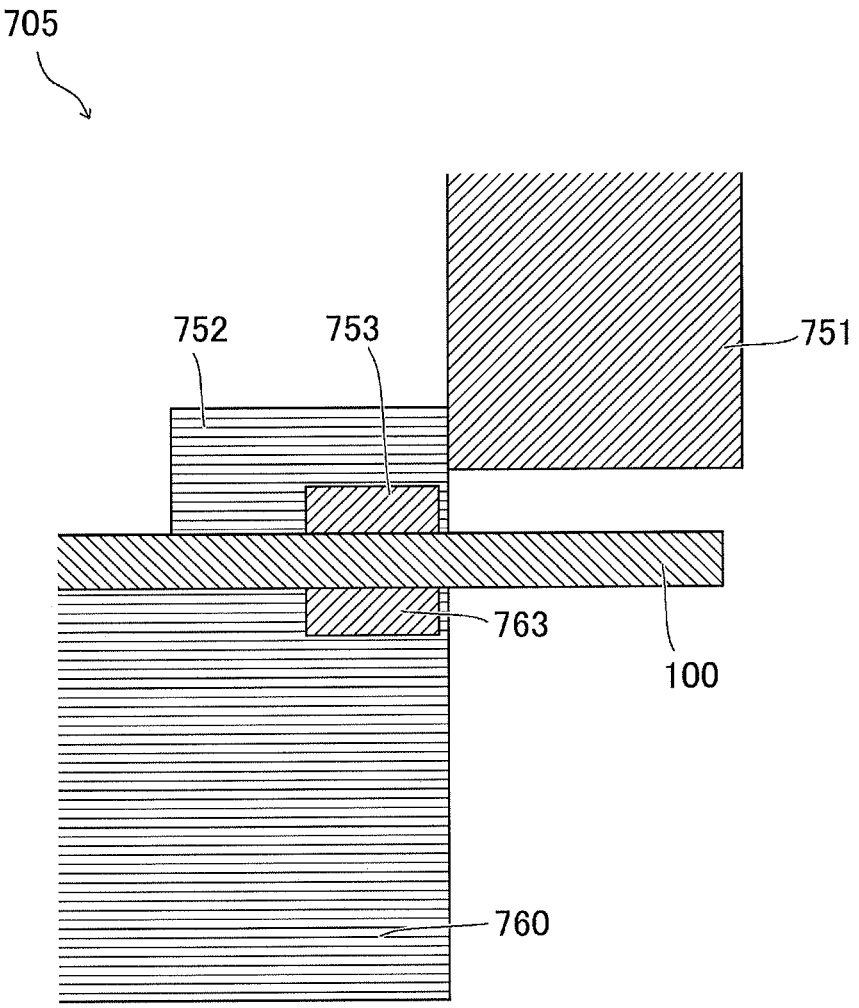
FIG. 5 is a partial cross-sectional view showing a relationship between the heating electrodes and the steel plate when still another punching machine is used.

FIG. 5 is a partial cross-sectional view showing a relationship between heating electrodes and the steel plate 100 when still another punching machine 705 is used. Unlike the punching machines 701 and 703, the punching machine 705 is not for punching a hole and instead is for cutting off an unnecessary part of the steel plate 100.

The punching machine 705 includes a punch 751 as an upper die. The punching machine 705 further includes, as a lower die, a punching die 760 including a second heating electrode 763. The steel plate 100 is fixed to the punching die 760. The steel plate 100 is fixed to the punching die 760 by a fixing jig 752 in which a first heating electrode 753 is embedded. When the steel plate 100 is fixed by the fixing jig 752, the first heating electrode 753 and the second heating electrode 763 are brought into contact with the respective surfaces of the steel plate 100 and face each other.

Further, the punching machine 705 includes, as a part of the control mechanism, a current applying control unit that applies a current to the first heating electrode and the second heating electrode so as to heat a part of the steel plate 100 including a trim edge punched by the punch 751. When a current is applied, a heating area including the trim edge is heated. When the heating area is heated by such an arrangement of the pair of heating electrodes, the trim edge can be sufficiently heated, and the residual strain concentrated on the peripheral part of the trim edge can be satisfactorily removed. Further, since the heating area is a part of the entire steel plate 100, electric power for heating unnecessary areas can be reduced, and overheating that causes softening and hardening can be avoided.

In the processing method in this case, the order of the heating step and the pulling-out step corresponding to FIG. 1 does not matter. That is, the processing method may only need to include the punching step of punching the steel plate 100 as a workpiece fixed to the punching die 760 by the punch 751 and the heating step of heating, by the first heating electrode 753 and the second heating electrode 763, the part of the steel plate 100 including the trim edge punched in the punching step. Further, since the heating step can be performed while the steel plate 100 is fixed to the punching die 760, an independent heating step of placing the steel plate 100 on a heating apparatus and heating it, which has been necessary in related art, can be omitted. This can shorten the time taken for a series of processing.

Figure 6:
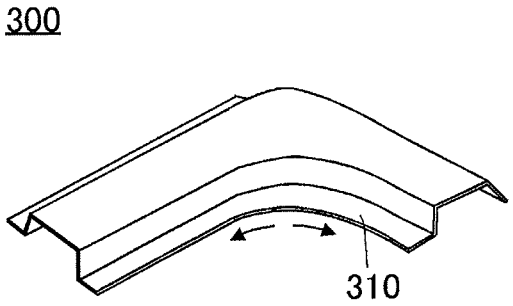
FIG. 6 illustrates an example of a formed product.

An example of a formed product formed by such a processing method will be described. FIG. 6 illustrates an A pillar lower 300 used for a window column of a vehicle as an example of the formed product. In the stretch flange step, a flange die is pressed against the trim edge, from which an unnecessary part has been cut off, to form a stretch flange. A stretch flange forming part 310 of the A pillar lower 300 is formed in this way.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. A method for processing a steel plate comprising:

punching a steel plate as a workpiece fixed to a punching die by a punch;

making a first heating electrode provided on a punch holder for supporting the punch and a second heating electrode provided on the punching die face each other by maintaining the punch in a state in which the punch penetrates the steel plate and heating a part of the steel plate including a trim edge punched in the punching; and pulling out the punch from the punching die, wherein the pulling-out is started based on a detected temperature of the trim edge.

2. The method according to claim 1, further comprising:

reducing heat generated in the heating; and forming a stretch flange at the trim edge.

3. The method according to claim 1, wherein relative positions of the punch holder and the punching die are adjusted so that the first heating electrode and the second heating electrode face each other at a bottom dead center of the punch.

4. The method according to claim 1, wherein each of the first heating electrode and the second heating electrode is a coil electrode for generating an induced electromotive force in the steel plate to carry out the heating, and the heating includes heating the part of the steel plate without bringing the coil electrode into contact with a surface of the steel plate.

5. The method according to claim 4, wherein in the heating, an insulator part provided on a peripheral part of each of the coil electrodes is brought into contact with the surface of the steel plate to heat the part of the steel plate.

6. A punching machine comprising:

a punch holder comprising a first heating electrode and configured to hold a punch for punching a steel plate as a workpiece;

a punching die comprising a second heating electrode, the steel plate being fixed to the punching die; and a current applying control unit configured to apply a current to the first heating electrode and the second heating electrode so that a part of the steel plate including a trim edge punched by the punch is heated when the first heating electrode and the second heating electrode face each other while the punch is penetrating the steel plate, wherein the punch is configured to be pulled out from the punching die when a temperature of the trim edge measured by a temperature sensor reaches a preset temperature.

7. A method for processing a steel plate comprising:

punching a steel plate as a workpiece fixed to a punching die by a punch;

heating a part of the steel plate including a trim edge punched in the punching by a first heating electrode provided on a fixing jig for fixing the steel plate to the punching die and a second heating electrode provided on the punching die; and pulling out the punch from the punching die, wherein the pulling-out is started based on a detected temperature of the trim edge.

8. A punching machine comprising:

a punching die including a second heating electrode, a steel plate as a workpiece is being fixed to the punching die;

a fixing jig including a first heating electrode and configured to fix the steel plate to the punching die by a punch; and a current applying control unit configured to apply a current to the first heating electrode and the second heating electrode so that a part of the steel plate including a trim edge punched by the punch is heated, wherein the punch is configured to be pulled out from the punching die when a temperature of the trim edge measured by a temperature sensor reaches a preset temperature.

* * * * *